US011316239B2

(12) United States Patent
Cardona, Jr. et al.

(10) Patent No.: US 11,316,239 B2
(45) Date of Patent: Apr. 26, 2022

(54) WAVEGUIDE TRANSITION BETWEEN FRONT AND REAR WINDOWS CONNECTED BY A TAPERED PLATE TO FORM UPPER AND LOWER CHAMBERS THAT DEFINE AN ENERGY PATH THROUGH THE TRANSITION

(71) Applicant: ELECTRONIC DESIGN & DEVELOPMENT, CORP., Tucson, AZ (US)

(72) Inventors: Sergio E. Cardona, Jr., Tucson, AZ (US); Kevin W. Patrick, Tucson, AZ (US)

(73) Assignee: ELECTRONIC DESIGN & DEVELOPMENT, CORP., Tucson, AZ (US)

( * ) Notice: Subject to any disclaimer, the term of this patent is extended or adjusted under 35 U.S.C. 154(b) by 14 days.

(21) Appl. No.: 16/846,135

(22) Filed: Apr. 10, 2020

(65) Prior Publication Data

US 2020/0343615 A1 Oct. 29, 2020

Related U.S. Application Data

(63) Continuation-in-part of application No. 16/750,691, filed on Jan. 23, 2020, now abandoned.

(60) Provisional application No. 62/795,815, filed on Jan. 23, 2019.

(51) Int. Cl.

| | |
|---|---|
| ***H01P 5/02*** | (2006.01) |
| ***H01P 5/08*** | (2006.01) |
| ***H01P 5/107*** | (2006.01) |
| ***H01P 5/18*** | (2006.01) |

(52) U.S. Cl.
CPC ..... *H01P 5/024* (2013.01); *H01P 5/082* (2013.01); *H01P 5/107* (2013.01); *H01P 5/181* (2013.01); *H01P 5/182* (2013.01)

(58) Field of Classification Search
CPC .. H01P 3/12; H01P 5/181; H01P 5/182; H01P 5/082; H01P 5/024; H01P 5/103; H01P 5/107
USPC ..... 333/24 R, 26, 248
See application file for complete search history.

(56) References Cited

U.S. PATENT DOCUMENTS 4,122,406 A * 10/1978 Salzberg ..... H01P 5/182 333/113
10,418,679 B2 * 9/2019 Parekh et al. ..... H01Q 19/132
2013/0214871 A1 * 8/2013 Nakamura et al. ..... H01P 5/107 333/26

(Continued)

OTHER PUBLICATIONS

H. T. Hui, Numerical and experimental studies of a helical antenna loaded by a dielectric resonator, Radio Science, vol. 32, No. 2 , pp. 295-304, Mar.-Apr. 1997.

(Continued)

*Primary Examiner* — Benny T Lee
(74) *Attorney, Agent, or Firm* — Nguyen Tarbet LLC

(57) ABSTRACT

The present invention features a waveguide transition. A waveguide transition is used to join two dissimilar segments of waveguide, in this case coplanar waveguide to rectangular waveguide, and vice-versa. Care taken during the design of the waveguide transition ensures that the reflection of electromagnetic waves, which may be traveling along the coplanar waveguide segment and toward the waveguide transition and subsequent rectangular waveguide segment, is minimized.

20 Claims, 4 Drawing Sheets

(56) References Cited

U.S. PATENT DOCUMENTS

| | | | |
|---|---|---|---|
| 2019/0348759 | A1 | 11/2019 | Walker et al. |
| 2019/0379427 | A1 | 12/2019 | Geekie et al. |

OTHER PUBLICATIONS

Rousstia, M. W. et al., Switched-beam array of dielectric rod antenna with RF-MEMS switch for millimeter-wave applications, Radio Sci., 2015, 50, 177-190.
Black et al., Breaking Down mmWave Barriers with Holographic Beam Forming, MW Journal, Feb. 2020, vol. 63, No. 2.
Waveguide to coax transitions, https://www.microwaves101.com/encyclopedias/waveguide-primer, Apr. 5, 2020.

* cited by examiner

WAVEGUIDE TRANSITION BETWEEN FRONT AND REAR WINDOWS CONNECTED BY A TAPERED PLATE TO FORM UPPER AND LOWER CHAMBERS THAT DEFINE AN ENERGY PATH THROUGH THE TRANSITION

CROSS-REFERENCES TO RELATED APPLICATIONS

This application is a continuation-in-part and claims benefit of U.S. patent application Ser. No. 16/750,691, now abandoned, filed Jan. 23, 2020, which is a non-provisional and claims benefit of U.S. Patent Application No. 62/795,815, filed Jan. 23, 2019, the specification(s) of which is/are incorporated herein in their entirety by reference.

BACKGROUND OF THE INVENTION

Field of the Invention

The present invention relates in general to linear passive microwave circuit element structures that mate one waveguiding medium to a second, dissimilar, waveguiding medium. In particular, the present invention discloses devices to mate rectangular waveguide to coplanar waveguide in a manner compatible with commonly available printed circuit board fabrication techniques.

Description of Related Art Including Information Disclosed

Various types of microwave media, which may be used for conveying microwave electromagnetic radiation within confined circuits, may find application within a given microwave circuit depending upon the circumstances in which a given microwave medium may be most convenient. Examples of microwave media structures may include rectangular waveguide, coaxial waveguide, and coplanar waveguide, among others. In order to join a segment of rectangular waveguide to a segment of coplanar waveguide with minimal connection losses, an interfacing block, which may be deemed a waveguide transition, may be required. In the prior art, joining a microwave medium with several conductors, such as coplanar waveguide or coaxial waveguide, to a medium with a single conductor, such as rectangular waveguide, may require mechanically complex and bulky assemblies, which themselves require extensive machining and joining, with consequent expense. Even with expense and complexity aside, the types of waveguide transitions found in prior art may demand precise control of their critical dimensions in all three dimensions of space. In the planar printed circuit media most amenable to microwave circuit design, however, only two dimensions of space may be freely available for microwave circuit design discretion, while the third dimension, which is the depth into the printed circuit board, may admit practically no design discretion. Hence, a means to interface between coplanar waveguide and rectangular waveguide, in a manner compatible with the two dimensions of design discretion available within planar printed circuit board technology, may be desirable in order to make the incremental cost of such waveguide transitions negligible. Further, it may be desirable that separate printed circuit boards be joined by such waveguide transitions without need for intervening connectors or cabling.

SUMMARY OF THE INVENTION

It is an objective of the present invention to provide devices that allow for the implementation of waveguide transitions that mate rectangular waveguide to coplanar waveguide in a form amenable to manufacture using planar printed circuit technology, as specified in the independent claims. Embodiments of the invention can be freely combined with each other if these embodiments are not mutually exclusive.

The waveguide transition of the present invention may mate a coplanar waveguide, which has both a center conductor and a grounded conductor, to a rectangular waveguide, which has a single conductor, through a common, electrically conducting coupling cavity that may act in conjunction with a tapered plate. The common coupling cavity may have two apertures through which to convey microwave electromagnetic radiation either from the coplanar waveguide to the rectangular waveguide, or vice versa. The tapered plate may join the two-conductor topology of the coplanar waveguide to the single-conductor topology of the rectangular waveguide so as to minimize insertion loss of electromagnetic wave power between the two apertures of the present invention. The coupling cavity and the tapered plate may exploit the full design discretion available to planar printed circuit design in the two dimensions, while imposing no extraordinary geometrical requirements in the third dimension of depth, which may make the coupling cavity and the tapered plate convenient for realizing highly integrated microwave circuits. The efficacy of the present invention may be measured by the metric of insertion loss, which may be the ratio of electromagnetic wave power incident upon the first aperture of the present invention, divided by the electromagnetic wave power propagated away from its second aperture.

One of the unique and inventive technical features of the present invention is that this waveguide transition may be both readily separable along the plane of the tapered plate, as well as readily fabricated in two separate planar printed circuit sub-assemblies. These sub-assemblies may be readily joined along the planes of respective tapered plates, and consequently the assembly may enjoy low insertion loss without requiring any calibration, tuning, intervening connectors or cabling. Without wishing to limit the invention to any theory or mechanism, it is believed that the technical feature of the present invention advantageously provides for unprecedented integration among coplanar waveguide and rectangular waveguide media in microwave circuits both within a single printed circuit board and among collections of printed circuit boards. This technical feature may make available complex microwave circuit designs that once may have been prohibitive in cost, complexity, area, and volume. None of the presently known prior art references or work has the unique inventive technical feature of the present invention. Furthermore, the prior art references teach away from the present invention. For example, prior art suggests that coplanar waveguide may be joined to rectangular waveguide by means of either a monopole radiator or a coupling loop, neither of whose constructions resembles the cross section of either coplanar waveguide or rectangular waveguide. Further, in the prior art, despite best design and manufacturing practices, each microwave circuit may require individual testing and tuning to achieve desired levels of performance. In the present invention, the tapered plate that may serve analogously to the monopole or loop may be realized in just two dimensions of planar design, by perforating the mating walls in the coplanar waveguide medium and the rectangular waveguide medium where the two media overlap. These same two dimensions of planar design may already be employed to control the critical conductor geometries, and hence the performance, of both the coplanar waveguide and rectangular waveguide. Therefore, the tapered plate may incur negligible incremental cost and complexity wherever it may be included. Furthermore, the inventive technical features of the present invention contributed to a surprising result. For example, the performance metric of insertion loss for the present invention may be found, by contrast with prior art, to require no tuning at all in order to meet required performance, further simplifying the waveguide transition design and improving its reliability over its operating life.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWINGS

The features and advantages of the present invention will become apparent from a consideration of the following detailed description presented in connection with the accompanying drawings in which.

DETAILED DESCRIPTION OF THE INVENTION

Figure 1A:
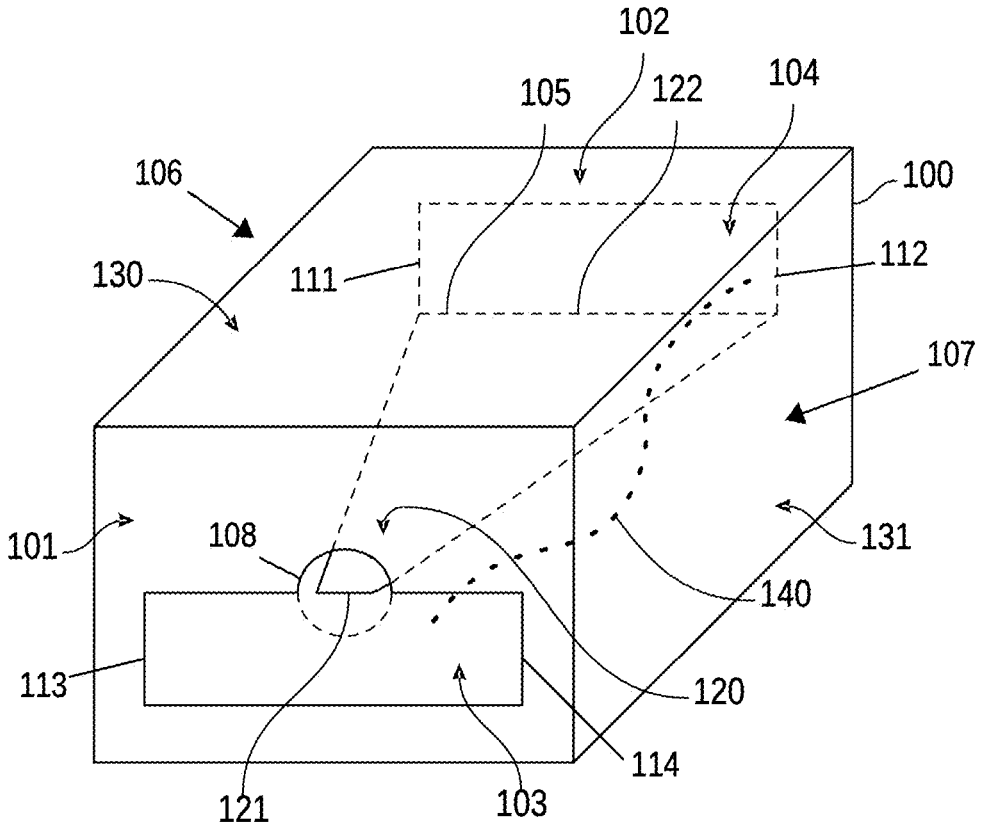
FIG. 1A shows a waveguide transition.

FIG. 1A shows a waveguide transition, which adapts one physical format for conveying electrical power into another physical format for conveying electrical power. In the present invention, the two formats under consideration are known to practitioners of the art as coplanar waveguide and rectangular waveguide. The coplanar waveguide connects to the front window (103), while the rectangular waveguide connects to the rear window (104).

FIG. 1A shows that the coplanar waveguide has two conductors, namely, the center conductor, which mates identically with the front edge (121), and the grounded conductor, which mates identically with the front window (103). Meanwhile, the rectangular waveguide has one conductor, which mates identically with the rear window (104).

FIG. 1A shows that the number of conductors mismatches between: two, for the coplanar waveguide; and one, for the rectangular waveguide. The waveguide transition, by the action of a container (100) in concert with a tapered plate (120), accomplishes the requisite adaptation in a manner that is perceived to be smooth and invisible to electrical power traveling from the coplanar waveguide, through the waveguide transition (along an energy path (140) beginning at the front window (103), going around the tapered plate (120), and exiting out the rear window (104)), and out of the rectangular waveguide. By a mathematical property of the waveguide transition called reciprocity, the reverse is also true: electrical power traveling from the rectangular waveguide, through the waveguide transition, and out the coplanar waveguide, sees equally as smooth and seamless an energy path. FIG. 1A also shows a first side barrier (106), a second side barrier (107), a first rear lateral edge (111), a second rear lateral edge (112), and a first front lateral edge (113).

Figure 1B:
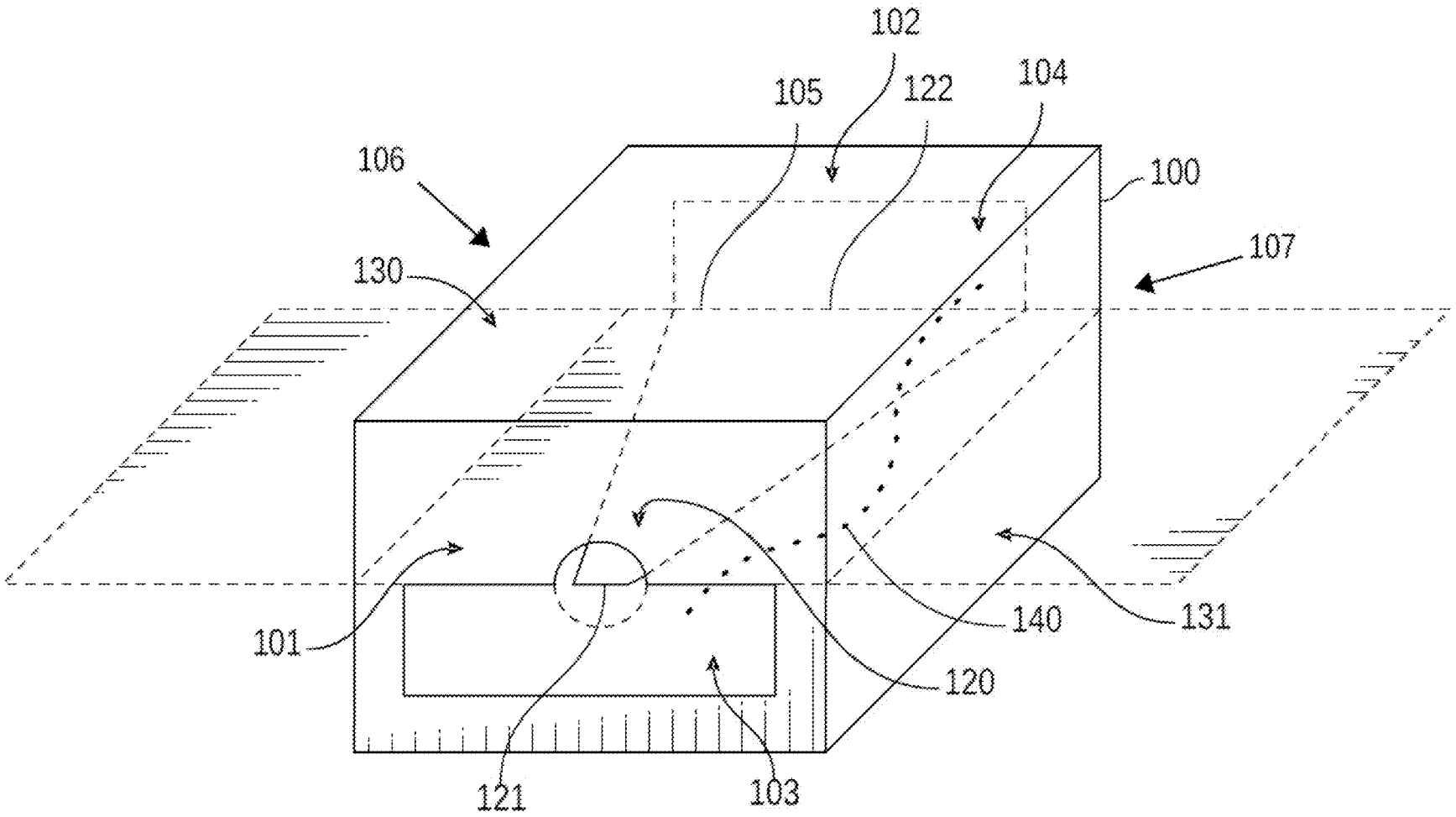
FIG. 1B shows the waveguide transition separated into upper and lower halves.

FIG. 1B shows an important property of the present invention: the waveguide transition may be separated into upper and lower halves, by a geometric plane that may in some embodiments be only conceptual in nature, while in other embodiments the structure of the waveguide transition may be readily separable (and optionally joinable) into its two constituent halves along said geometric plane.

FIG. 1B shows the utility of the waveguide transition's separability is due to the fact that its upper chamber (130) and lower chamber (131) may be fabricated on separate printed circuit boards, and be joined as desired by a simple and inexpensive soldering operation. This existence of a mutual, well-defined, electrically optimal interface along the plane of the tapered plate (120) made available by the present invention permits these separate printed circuit boards to be manufactured by separate firms, if desired, and still join seamlessly (from the view of electrical power flow) via the soldering operation. Existing alternatives to the present invention, for joining coplanar waveguide to rectangular waveguide on different plane levels, are complex, bulky, and expensive by contrast with the present invention. The present invention thereby enables higher levels of system integration at negligible additional cost. FIG. 1B also shows a container (100), a front face (101), a rear face (102), a front window (103), an interface edge (105), a front edge (121), and a rear edge (122).

Figure 2:
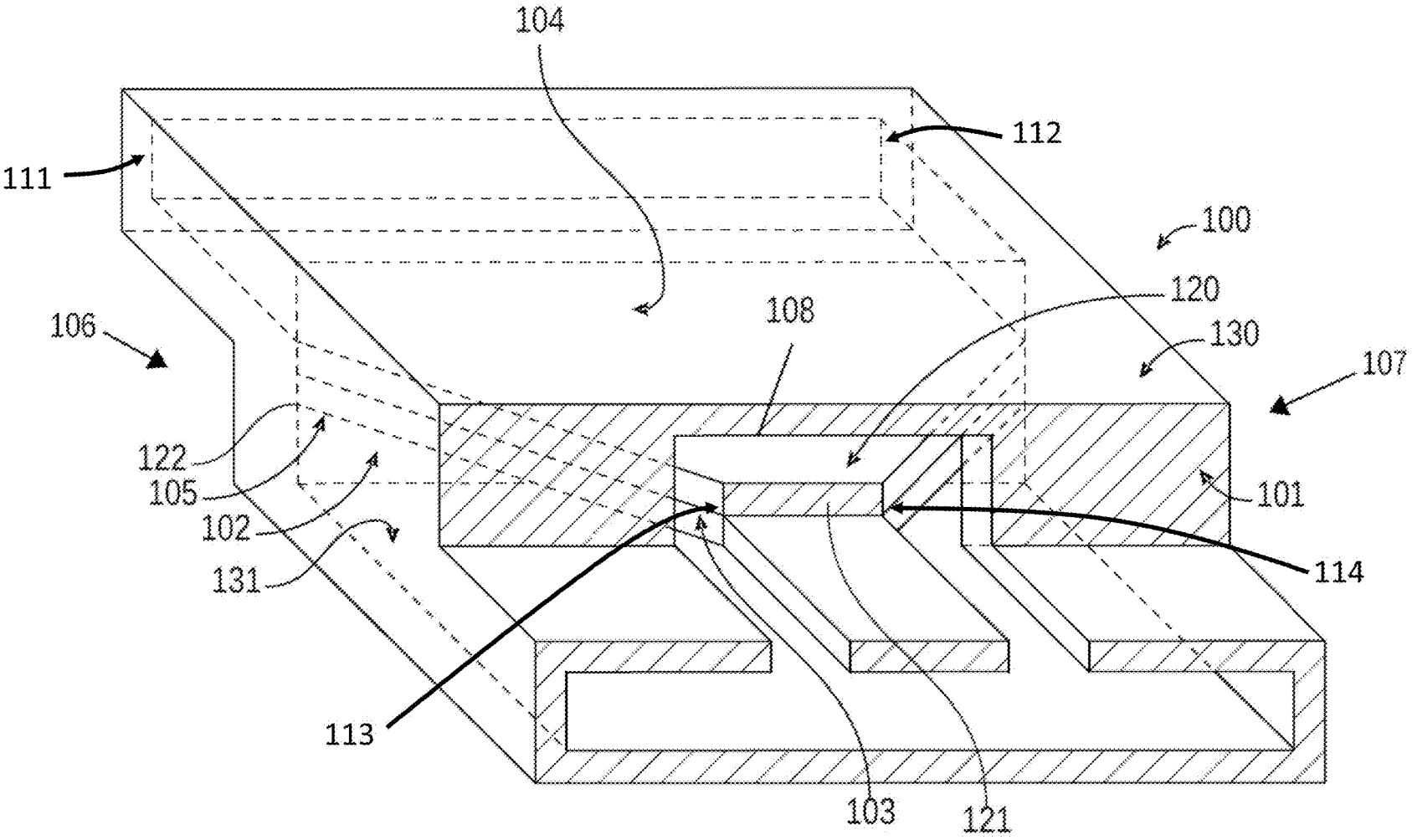
FIG. 2 shows another view of the waveguide transition.

FIG. 2 shows another view of the waveguide transition, within a greater context, and demonstrates the case when the walls of the container (100) and the tapered plate (120) have finite thickness. Beginning with the waveguide transition in the center, a section of coplanar waveguide extends generally toward the figure's viewpoint, such that it appears at the bottom of FIG. 2, while a section of rectangular waveguide extends generally away from the figure's viewpoint, such that it appears at the top of FIG. 2. FIG. 2 also shows a container (100), a front window (103), an interface edge (105), a tapered plate (120), a front edge (121), a rear edge (122), a upper chamber (130), and a lower chamber (131).

Figure 3:
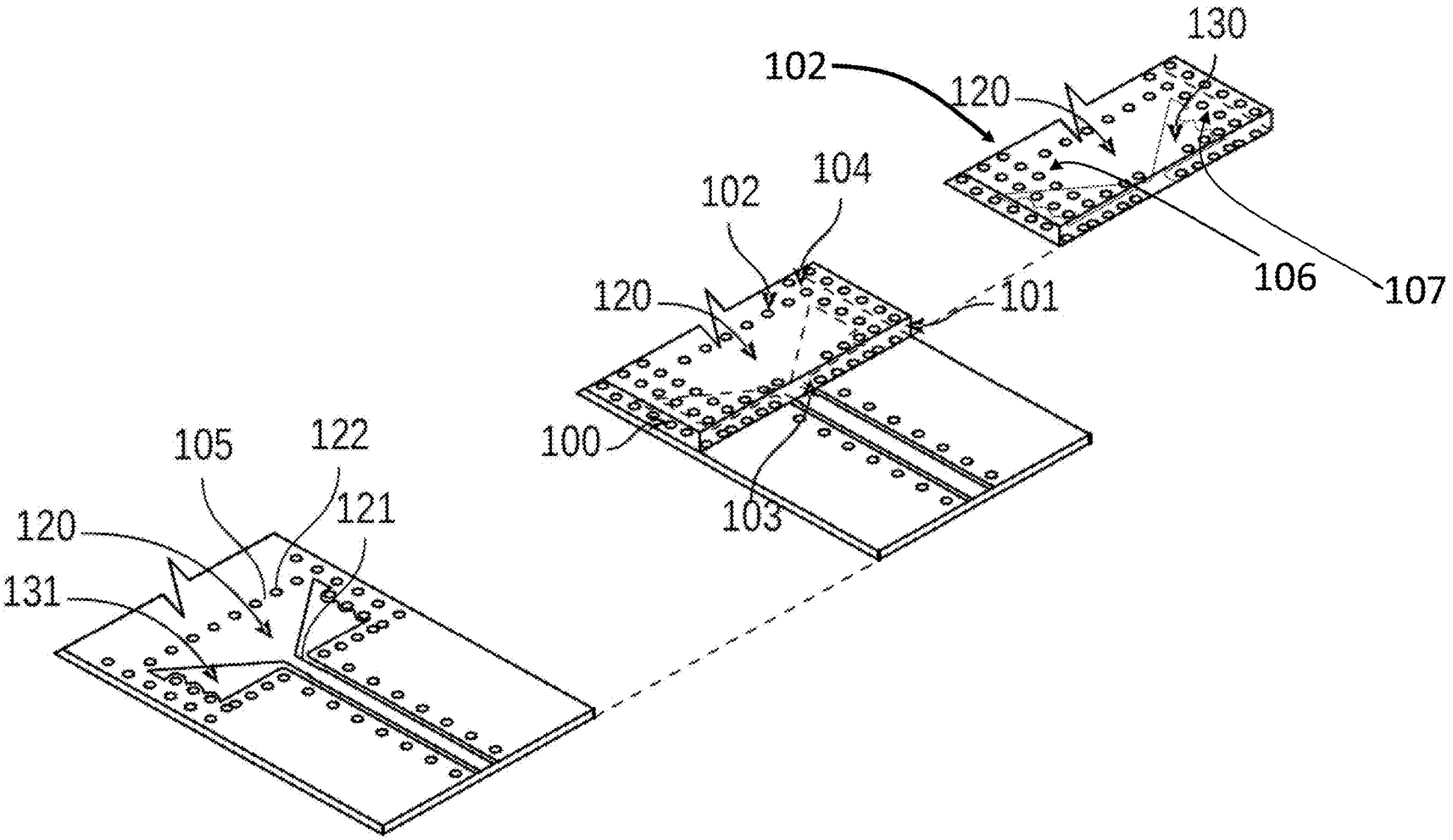
FIG. 3 shows an example embodiment of the present invention for the case where the present invention may take its form from two sections of printed circuit board.

FIG. 3 shows an example embodiment of the present invention for the case where the present invention may take its form from two sections of printed circuit board, indicated for instance by the upper chamber (130) and the lower chamber (131) at the far extents of FIG. 3. Extension lines demonstrate the joining of the upper chamber (130) and the lower chamber (131) into a single assembly, the container (100), that is held intact by a soldering operation along plane of the tapered plate (120).

FIG. 3 shows that, in the example embodiment: the upper surface of the container (100) may be implemented by patterning the upper foil of the upper two-side plated dielectric lamina of printed circuit board stock; the sidewalls of the upper chamber (130) may be implemented by tight arrays of vias joining electrically the upper foil to the lower foil of the upper two-side plated dielectric lamina, wherein the arrays may be deemed tight by their inter-via pitch's being much less than one wavelength of the electromagnetic waves traveling in the coplanar waveguide or the rectangular waveguide; the instance of the tapered plate (120) belonging to the upper chamber (130) may be implemented by patterning the lower foil of the upper two-side plated dielectric lamina; the instance of the tapered plate (120) belonging to the lower chamber (131) may be implemented by patterning the upper foil of the lower two-side plated dielectric lamina; the sidewalls of the lower chamber (131) may be implemented by tight arrays of vias joining electrically the upper foil to the lower foil of the lower two-side plated dielectric lamina; the lower surface of the container (100) may be implemented by patterning the lower foil of the lower two-side plated dielectric lamina. FIG. 3 also shows a container (100), a front window (103), a rear window (104), and an interface edge (105).

Referring to FIG. 1A, the present invention features a waveguide transition. A waveguide transition is used to join two dissimilar segments of waveguide, in this case coplanar waveguide to rectangular waveguide, and vice-versa. Care taken during the design of the waveguide transition ensures that the reflection of electromagnetic waves, which may be traveling along the coplanar waveguide segment and toward the waveguide transition and subsequent rectangular waveguide segment, is minimized.

In some embodiments, the waveguide transition may comprise a container (100) with a front face (101), a rear face (102), a front window (103), and a rear window (104). In the interest of efficiency and to avoid attenuation of the signal power and field coupling, the waveguide transition contains the electromagnetic wave power that enters the waveguide transition through the front window (103), and permits the electromagnetic wave power to exit only via the rear window (104). Because the waveguide transition joins waveguides on two separate levels, the waveguide transition's front face (101) seals off the front end of the rectangular waveguide segment that mates with the waveguide transition's rear window (104); likewise, the waveguide transition's rear face (102) seals off the rear end of the coplanar waveguide segment that mates with the waveguide transition's front window (103).

The container (100) may be electrically conductive. The containment of electromagnetic wave power and fields is best accomplished by employing electrically conductive materials, typically elemental metals or alloys of copper, gold, silver, nickel, and tin.

The front window (103) may be planar and may perforate the front face (101). The flush mating of the coplanar waveguide segment with the waveguide transition is most easily accomplished when the front window lies in a geometric plane. Again, the flush mating is desirable to avoid attenuation of the signal power and field coupling. This plane also defines the extent of the tapered plate (120) (whose function is inextricable from that of the container (100) in accomplishing the performance of the waveguide transition) within the waveguide transition.

The rear window (104) may perforate the rear face (102) and may have an interface edge (105). Clearly, the electromagnetic wave energy that enters the waveguide transition needs an avenue by which to exit the waveguide transition. That avenue may be the rear window (104), which lies in the rear face (102), and may join by electrical conduction with the tapered plate (120) along the interface edge of the rear window (104).

In some embodiments, the waveguide transition may further comprise a tapered plate (120) with a front edge (121) and a rear edge (122). The tapered plate (120) may play an essential role in interfacing the two dissimilar segments of waveguide, coplanar waveguide and rectangular waveguide. Because the tapered plate (120) may interact strongly with both dissimilar waveguide segments, the tapered plate (120) has a front edge (121) lying in the front window (103), and a rear edge (122) lying in the rear window (104).

The tapered plate (120) may be electrically conducting. The containment of electromagnetic wave power and fields may be best accomplished by employing electrically conductive materials, typically elemental metals or alloys of copper, gold, silver, nickel, and tin.

The rear edge (122) of the tapered plate (120) may electrically connect to the interface edge (105) along the entire extent of the rear edge (122). The rear edge (122) of the tapered plate (120) may join by electrical conduction with the rear window's (104) interface edge (105).

The tapered plate (120) may extend and taper toward the front face (101) from the rear edge (122), bisecting the interior of the container (100) into an upper chamber (130) and a lower chamber (131). The geometric plane including the tapered plate (120) may divide the container (100) roughly in half. The halves may be known as the upper chamber (130) and the lower chamber (131). Because the conductor on the coplanar waveguide segment that joins with the tapered plate may be narrower than the interface edge (105) of the rear window (104), the tapered plate (120) may taper toward the front window (103) and the front face (101). The exact nature of this taper may be a straight line (linear taper), obey some non-linear mathematical description (exponential taper), or be something else.

The front edge (121) may lie in the plane of the front window (103) without touching any edge of the front window (103). Again, the front edge (121) of the tapered plate (120) may not be permitted to touch the boundary of the front window (103), since the coplanar waveguide segment may have two distinct conductors. Additionally, the front edge (121) may reach the center conductor of the coplanar waveguide segment, which may end in the plane of the front window (103).

In some embodiments, an energy path (140) is created to guide electromagnetic wave energy. The entire conception and rationale for creating the waveguide transition may be to create an appropriate energy path (140) that guides electromagnetic energy from the front window (103) to the rear window (104) while minimizing the reflection of electromagnetic waves due to the waveguide transition. The energy path (140) constitutes a continuous connection between the front window (103) and the rear window (104).

As seen in FIG. 1B, the energy path (140) travels from the front window (103) through the lower chamber (131) around the tapered plate (120) through the upper chamber (130) and to the rear window (104). The energy path (140), with the mirror image thereof around the opposite side of the tapered plate (120), may be the only routes (since electromagnetic wave amplitude may rapidly decay if traveling within the metal conductors of the container (100) or the tapered plate (120)) by which electromagnetic wave power may transit the waveguide transition. The energy path (140) may minimize the reflection of incident electromagnetic wave energy and maximize the transmission of incident electromagnetic wave energy. Indeed, the energy path (140) that remains open once the geometry of the container (100) and the tapered plate (120) may have been specified, may be chosen for the express purpose of minimizing the reflection of incident electromagnetic wave energy and, since the waveguide transition may be nearly lossless, of necessity maximizing the transmission of electromagnetic wave energy. The energy path (140) may constitute a continuous connection between the front window (103) and the rear window (104).

In some embodiments, the container (100) may be shaped as a rectangular prism. Since rectangular waveguide invariably has a rectangular cross section, and a coplanar waveguide has a parallel ground plane joined to the surface ground plane conductor by perpendicular sidewalls, the natural form for the front window (103) and rear window (104) is rectangular in shape, so the simplest form for the present invention may be that of a rectangular prism. The example embodiment shown in FIG. 3 demonstrates the case wherein container (100) may be shaped as a rectangular prism.

In some embodiments, the container (100) may have a first side barrier (106) and an opposite second side barrier (107). The first side barrier (106) and the second side barrier (107) may be present when the container (100) is shaped as a rectangular prism. The nature of implementation for the first side barrier (106) and the second side barrier (107) may vary in some embodiments, as may the relative proximities between: the front window (103) and the rear window (104) with respect to the first side barrier (106); and, the front window (103) and the rear window (104) with respect to the second side barrier (107).

In some embodiments, the first side barrier (106) may be a surface, and the second side barrier (107) may be a surface. The first side barrier (106) and second side barrier (107) may be continuous surfaces, for instance, in the case wherein the upper chamber (130) may be derived from a section of tubular rectangular waveguide. FIG. 2 shows an example embodiment wherein the first side barrier (106) and the second side barrier (107) may be continuous surfaces.

In some embodiments, the first side barrier (106) may comprise a plurality of pillars, and the second side barrier (107) may comprise a plurality of pillars. In the example embodiment shown in FIG. 3, the first side barrier (106) and the second side barrier (107) typically may be realized by plated-through vias commonly available on printed circuit board fabrication processes, and hence the plated-through vias function as pillars. Electrically, the behavior of the present invention wherein the first side barrier (106) and the second side barrier (107) may be realized by pluralities of pillars that are equivalent to a solid metal surface, provided that the pillars may be spaced closely enough together, which is much less than one wavelength at the operating frequency for the present invention. The example embodiment in FIG. 3 shows that about five vias that may constitute the first side barrier (106) and the second side barrier (107) of the present invention.

In some embodiments, the front face (101) may be a surface, and the rear face (102) may be a surface. The front face (101) and rear face (102) may be continuous surfaces, for instance, in the case wherein the upper chamber (130) may be derived from a section of tubular rectangular waveguide. FIG. 2 shows an example embodiment wherein the front face (101) and the rear face (102) may be continuous surfaces.

In some embodiments, the front face (101) may comprise a plurality of pillars, and the rear face (102) may comprise a plurality of pillars. In the example embodiment shown in FIG. 3, the front face (101) and the rear face (102) typically may be realized by plated-through vias commonly available on printed circuit board fabrication processes, and hence the plated-through vias function as pillars.

In some embodiments, as shown in FIGS. 1A and 2, the front window (103) may comprise an opening (108) about the front edge (121). For optimal performance of the present invention, it may be desirable that the front window (103) be as small as possible without violating the necessarily two-conductor topology of the coplanar waveguide. Accordingly, a small clearance, the opening (108), may be formed in the front window (103) which admits the coplanar waveguide center conductor with minimal reduction in area of the remaining front face (103) where it contains the upper chamber (130). FIG. 2 shows an example embodiment in which an opening (108) may accommodate the coplanar waveguide center conductor.

In some embodiments, the front window (103) may be rectangular, and the rear window (104) may be rectangular. Since rectangular waveguide invariably has a rectangular cross section, and since coplanar waveguide has a parallel ground plane joined to the surface ground plane conductor by perpendicular sidewalls, the natural form for the front window (103) and rear window (104) to take on may be rectangular. The rectangular form for the front window (103) may be augmented by an opening (108), as shown in FIG. 2.

In some embodiments, the front window (103) and the rear window (104) may not overlap when viewed along the plane of the tapered plate (120). For the case in which the waveguide transition may have walls of finite thickness, as in the example embodiment of FIG. 2, the rear window (104) may coincide not at all with the front window (103), when viewed along the plane of the tapered plate.

In some embodiments, the tapered plate (120) may taper linearly from the font edge (121) to the rear edge (122). In the example embodiments shown in FIGS. 1A and 1B FIG. 2 and FIG. 3, the tapered plate (120) may taper linearly from the ends of the front edge (121) to the respective ends of the rear edge (122), since a line may be the simplest geometry to join two points.

In some embodiments, the tapered plate (120) may taper exponentially from the front edge (121) to the rear edge (122). Although a tapered plate (120) tapering linearly is shown in FIGS. 1A and 1B, FIG. 2, FIG. 3, improved performance (reduced reflection, increased transmission, broadened bandwidth) of the present invention may be possible by employing taper sections composed of exponential tapers.

In some embodiments, the extent of the rear edge (122) may be less than the extent of the interface edge (105). To the extent that performance of the present invention improves, there is no necessary reason that the rear edge (122) of the tapered plate (120) extend the entire extent of the interface edge (105).

In some embodiments, the first side barrier (106) may coincide with the first rear lateral edge (111) of the rear window (104). FIG. 2 shows exactly such an example embodiment, which may improve performance of the present invention.

In some embodiments, the second side barrier (107) may coincide with the second rear lateral edge (112) of the rear window (104). FIG. 2 shows exactly such an example embodiment, which may improve performance of the present invention.

In some embodiments, the distance between the front edge (121) and the rear edge (122) may be in the range of ⅕ of a wavelength to ⅗ of a wavelength at the operating frequency. The waveguide techniques of rectangular waveguide and coplanar waveguide may become useful when the dimensions of the microwave and millimeter wave circuit elements become comparable with a wavelength at the nominal operating frequency of the waveguide structure. For example, at a center frequency of 29.9 GHz in the microwave Ka-band employed in 5G networking, the associated free-space wavelength is given by the speed of light in a vacuum (about $2.99 \cdot 10^8$ m/s) divided by 29.9 GHz, or 1 cm. Performance-improving resonances within structures such as the present invention may occur when the distance between the front edge (121) and the rear edge (122) lie in the range of about ¼ to ½ of a wavelength within the waveguide media. The wavelength of waves guided within waveguide media, such as rectangular waveguide and coplanar waveguide, may differ from the free-space wavelength at the nominal operating frequency; therefore, the example evaluation of the free-space wavelength above is given solely to demonstrate the approximate scale of features of the present invention in a specific case.

In some embodiments, the upper chamber (130) may be fabricated in a planar printed circuit process, and the lower chamber (131) may be fabricated in a planar printed circuit process. Precisely this case may demonstrate the greatest utility of the present invention, as may be seen in FIG. 3. The upper chamber (130), constituting the first half of the present invention, may reside at the upper right of the figure, where for clarity the upper chamber is shown isolated from the completed assembly the at center of FIG. 3. The upper chamber (130) may be fabricated in planar printed circuit technology from: an upper surface of patterned conducting metal foil whose form may be substantially rectangular; a lower surface of patterned conducting metal foil whose shape may match the upper instance of the tapered plate (120), in addition to perimeter wall foundations that may join to the upper surface through a plurality of conducting plated-through holes (vias); and a non-conducting dielectric layer that may reside between the upper surface and the lower surface, and may provide mechanical support to the upper and lower surfaces. In a complementary fashion, a section of coplanar waveguide may lead to the lower chamber (131), which may constitute the second half of the present invention, and which may reside at the lower left of the figure, where for clarity it is shown isolated from the completed assembly at the center of FIG. 3. The lower chamber (131) may be fabricated in planar printed circuit technology from: a lower surface of patterned conducting metal foil whose form may be substantially rectangular; an upper surface of patterned conducting metal foil whose form may include the lower instance of the tapered plate (120), in addition to perimeter wall headers that may join to the lower surface through a plurality of conducting plated-through holes (vias); and a non-conducting dielectric layer that may reside between the upper surface and the lower surface, and may provide mechanical support to them. The completed assembly may be mechanically and electrically joined by positioning the upper chamber (130) and the lower chamber (131) such that their tapered plate (120) instances may about coincide and mate throughout, and where the perimeter foundations of the upper chamber (130) may about coincide with the perimeter wall headers of the lower chamber (131), then permitting the joining of the surfaces mated thereby by a soldering operation.

In some embodiments, the first side barrier (106) may coincide with the first front lateral edge (113) of the front window (103). FIG. 2 may demonstrate an embodiment of such a geometry.

In some embodiments, second side barrier (107) may coincide with the second front lateral edge (114) of the front window (103). FIG. 2 may demonstrate an embodiment of such a geometry.

In some embodiments, the opening (108) may extend the full height of the upper chamber (130). In FIG. 3, the opening (108) around the center conductor of the coplanar waveguide may extend to the upper surface of the upper chamber (130).

EXAMPLE

The following is a non-limiting example of the present invention. It is to be understood that the example is not intended to limit the present invention in any way. Equivalents or substitutes are within the scope of the present invention.

In one example embodiment, a 5G band pass filter implementation comprises two waveguide transition instances as described in the present invention. The example embodiment: is fabricated in a two conductor-layer planar printed circuit technology, wherein the structural dielectric material supporting the printed-circuit board lamina has an effective relative dielectric constant of about 3.0; operates at a center frequency of 28 gigahertz; and is available as a component for solder attachment to a host printed circuit board whose complementary footprint is specified by the product data sheet of this example embodiment. Its container (100): has the form of a rectangular prism; comprises a tapered plate (120) that tapers linearly from rear edge (122) to front edge (121); comprises a front face (101), a rear face (102), a first side barrier (106), and a second side barrier (107), each of which comprises a plurality of pillars; and is separable, and joinable by a soldering operation, along the plane of the tapered plate (120). In the example embodiment, the distance between the front edge (121) and the rear edge (122) of the tapered plate (120) lies in the range of ⅕ of a wavelength to ⅗ of a wavelength at the operating frequency of 28 gigahertz.

FIG. 3 shows a close-in view of the waveguide transition of the present invention as used in this example embodiment. The component described in this example embodiment is visible at the upper right of FIG. 3, wherein the waveguide transition upper chamber (130) and tapered plate (120) are indicated. Also visible are the pluralities of pillars (plated-through vias) that constitute the front face (101), the rear face (102), the first side barrier (106), and the second side barrier (107). The tapered plate (120) tapers linearly from the rear edge (122) to the front edge (121). The lower surface of the upper chamber (130) is exposed, electrically conducting, metal that has been conditioned to accept solder attachment.

FIG. 3 shows in the lower left quadrant thereof the host printed circuit board where the printed circuit participates in the waveguide transition of the present invention. Indicated are the lower chamber (131), the tapered plate (120) and its front edge (121) and rear edge (122). As is the case for the upper chamber (130), in the lower chamber (131) pluralities of pillars constitute the front face (101), the rear face (102), the first side barrier (106) and the second side barrier (107), and again the tapered plate (120) tapers linearly from the rear edge (122) to the front edge (121). The upper surface of the lower chamber (131) is exposed, electrically conducting, metal that has been conditioned to accept solder attachment.

In the center of FIG. 3, an instance of the upper chamber (130) and an instance of the lower chamber (131) have been slid into position along the dashed extension lines to complete the waveguide transition of the present invention. With its two halves positioned relatively in this manner, a soldering operation readily joins them both electrically and mechanically. Because the printed circuit materials used to fabricate upper chamber (130) and the lower chamber (131) may be chosen to have about matching coefficients of thermal expansion, shear stress along the solder joint of the completed assembly is minimized under conditions of temperature excursion.

In FIG. 3, the distance between the front edge (121) and the rear edge (122) of the tapered plate (120) is about (0.11 inch/0.297 inch=0.37) wavelengths in the coplanar waveguide medium at 28 gigahertz, which is in the range of ⅕ to ⅗ of the wavelength in the coplanar medium. The wavelength in the coplanar medium is about equal to the free-space wavelength at 28 gigahertz, 1.068 centimeter=0.42 inch, divided by the square root of the effective relative dielectric constant of the medium, which has a value of about 2.0 for the case in which the substrate dielectric has a relative dielectric constant of about 3.0. The waveguide transition of the present invention at the operating frequency that is, therefore, a distributed electromagnetic element, wherein a distributed electromagnetic element is characterized by physical dimensions that are comparable to, or larger than, one wavelength at the operating frequency.

When two of the waveguide transitions of the present invention, plus six waveguide resonator sections, constitute a 5G band pass filter in this example embodiment, the entire system achieves a typical insertion loss of about just 1.45 decibels. Each instance of the present invention, then, contributes no more than half of that. Actually, most of the insertion loss is contributed to the filter itself and almost none of the loss is from the waveguide to coplaner waveguide transitions.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A waveguide transition comprising:

A) a container having a front face, a rear face, a front window, and a rear window, wherein the container is electrically conducting, wherein the front window perforates the front face, wherein the rear window perforates the rear face, wherein the rear window has an interface edge;

B) a tapered plate having a front edge and a rear edge, wherein the tapered plate is electrically conducting, wherein the tapered plate bisects the container into an upper chamber and a lower chamber, wherein the rear edge connects electrically to the interface edge along the entire extent of the rear edge, wherein the tapered plate extends toward the front face, wherein the tapered plate tapers from the rear edge toward the front edge, wherein the front edge is exposed to the front window;

wherein an energy path is created to guide electromagnetic wave energy, wherein the energy path can be traced from the front window through the lower chamber around the tapered plate through the upper chamber to the rear window, wherein the energy path minimizes the reflection of incident electromagnetic wave energy, wherein the energy path maximizes the transmission of incident electromagnetic wave energy.

2. The waveguide transition of claim 1, wherein the container is shaped as a rectangular prism.

3. The waveguide transition of claim 2, wherein the container has a first side barrier and an opposite second side barrier.

4. The waveguide transition of claim 3, wherein the first side barrier comprises a plurality of pillars, wherein the second side barrier comprises a plurality of pillars.

5. The waveguide transition of claim 4, wherein the front face comprises a plurality of pillars, wherein the rear face comprises a plurality of pillars.

6. The waveguide transition of claim 3, wherein the first side barrier is a surface, wherein the second side barrier is a surface.

7. The waveguide transition of claim 6, wherein the front face includes a front surface, wherein the rear face includes a rear surface.

8. The waveguide transition of claim 1, wherein the front window comprises an opening about the front edge.

9. The waveguide transition of claim 1, wherein the extent of the rear edge is less than the extent of the interface edge.

10. The waveguide transition of claim 1, wherein the front window and the rear window have no overlap when viewed along the plane of the tapered plate.

11. The waveguide transition of claim 1, wherein the tapered plate tapers linearly from the front edge to the rear edge.

12. The waveguide transition of claim 1, wherein the tapered plate tapers non-linearly from the front edge to the rear edge.

13. The waveguide transition of claim 1, wherein the front window is rectangular in shape, wherein the rear window is rectangular in shape.

14. The waveguide transition of claim 13, wherein a first side barrier coincides with a first rear lateral edge of the rear window.

15. The waveguide transition of claim 13, wherein a second side barrier coincides with a second rear lateral edge of the rear window.

16. The waveguide transition of claim 13, wherein a first side barrier coincides with a first front lateral edge of the front window.

17. The waveguide transition of claim 13, wherein a second side barrier coincides with a second front lateral edge of the front window.

18. The waveguide transition of claim 1, wherein a distance between the front edge and the rear edge is in the range of ⅕ of a wavelength to ⅗ of a wavelength at an operating frequency.

19. The waveguide transition of claim 1, wherein the upper chamber is fabricated in a planar printed circuit process, wherein the lower chamber is fabricated in a planar printed circuit process.

20. The waveguide transition of claim 8, wherein the opening extends the full height of the upper chamber.

* * * * *